US010134376B2

(12) United States Patent
Zhang et al.

(10) Patent No.: US 10,134,376 B2
(45) Date of Patent: Nov. 20, 2018

(54) PNEUMATIC SOUNDER AND CONTROL SYSTEM THEREOF

(71) Applicant: NANJING CHANGRONG ACOUSTIC INC., Jiangsu (CN)

(72) Inventors: Rongchu Zhang, Jiangsu (CN); Qingxian Qi, Jiangsu (CN)

(73) Assignee: NANJING CHANGRONG ACOUSTIC INC., Jiangsu (CN)

( * ) Notice: Subject to any disclaimer, the term of this patent is extended or adjusted under 35 U.S.C. 154(b) by 0 days.

(21) Appl. No.: 15/580,268

(22) PCT Filed: Nov. 4, 2015

(86) PCT No.: PCT/CN2015/093812
§ 371 (c)(1),
(2) Date: Dec. 6, 2017

(87) PCT Pub. No.: WO2017/004913
PCT Pub. Date: Jan. 12, 2017

(65) Prior Publication Data

US 2018/0166055 A1 Jun. 14, 2018

(30) Foreign Application Priority Data

Jul. 8, 2015 (CN) ..... 2015 1 0396628

(51) Int. Cl.
*G10K 9/04* (2006.01)
*G10K 9/13* (2006.01)
(Continued)

(52) U.S. Cl.
CPC ..... *G10K 9/04* (2013.01); *G10K 7/00* (2013.01); *G10K 9/13* (2013.01); *G10K 9/22* (2013.01)

(58) Field of Classification Search
CPC .. G10K 9/04; G10K 9/13; G10K 9/18; G10K 9/20; G10K 9/22; G10K 15/00; G10K 15/04; G10K 15/043; G10K 7/00
(Continued)

(56) References Cited

U.S. PATENT DOCUMENTS 1,493,340 A * 5/1924 Hahnemann et al. ..... G10K 1/068 116/27

FOREIGN PATENT DOCUMENTS

CN 2694423 4/2005
CN 101282590 10/2008
(Continued)

OTHER PUBLICATIONS

"International Search Report (Form PCT/ISA/210)", dated Feb. 22, 2016, with English translation thereof, pp. 1-4.

*Primary Examiner* — R. A. Smith
(74) *Attorney, Agent, or Firm* — JCIPRNET

(57) ABSTRACT

A pneumatic sounder and a control system thereof are disclosed. The pneumatic sounder comprises double magnets and a double-moving coil assembly. The double magnets comprise a first magnet and a second magnet, and the double-moving coil assembly comprises a first moving coil and a second moving coil. The first moving coil is disposed in a magnetic field of the first magnet, and the second moving coil is disposed in a magnetic field of the second magnet. The first moving coil and the second moving coil are connected to an electrical signal control system respectively, and a control system for the pneumatic sounder is also provided. The sounder greatly enhances adjustment efficiency of a cutting seam, reduces energy consumption for driving moving coils, guarantees services lives of the moving coils, and increases reliability of a system.

9 Claims, 1 Drawing Sheet

(51) Int. Cl.
*G10K 9/22* (2006.01)
*G10K 7/00* (2006.01)

(58) Field of Classification Search
USPC ..... 116/137 R, 142 FP; 340/404.1
See application file for complete search history.

(56) References Cited

FOREIGN PATENT DOCUMENTS

| | | |
|---|---|---|
| CN | 102623001 | 8/2012 |
| CN | 104091590 | 10/2014 |
| CN | 104992700 | 10/2015 |
| GB | 201660 | 8/1923 |

* cited by examiner

PNEUMATIC SOUNDER AND CONTROL SYSTEM THEREOF

CROSS-REFERENCE TO RELATED APPLICATION

This application is a 371 international application of PCT application serial no. PCT/CN2015/093812, filed on Nov. 4, 2015, which claims the priority benefit of China application no. 201510396628.2, filed on Jul. 8, 2015. The entirety of each of the above-mentioned patent applications is hereby incorporated by reference herein and made a part of this specification.

BACKGROUND OF THE INVENTION

1. Field of the Invention

The present invention relates to the technical field of pneumatic sounding, and particularly to a pneumatic sounder and a control system thereof.

2. Description of Related Art

Relevant researches show that a high-intensity sounder can generate sound waves of sinusoidal, random, and composite traveling waves within a given frequency range by using an electrical signal to control an air flow to generate high-intensity noise. The high-intensity sounder can act as a sound source of a traveling wave tube, a reverberation room, and a free sound field acoustic experiment. The high-intensity sounder can simulate noise and ultrasonic waves generated by an engine when an aircraft such as an airplane and a rocket is in flight.

The patent application CN2694423Y discloses a pneumatic sounder capable of generating high-intensity noise, mainly including a magnet, a moving and static coil assembly, an air flow inlet, and an air flow outlet. The moving coil is connected to an electrical signal control system and moves based on electromagnetism, and a gap between the moving coil and the static coil changes with the motion of the moving coil. An air flow enters from the air flow inlet, flows through the gap between the moving coil and the static coil upon reaching the moving and static coil assembly, and is cut by the moving and static coil assembly to generate a sound wave. When the moving and static coil assembly consisting of the moving coil and the static coil is in operation, the static coil remains stationery, and the moving coil reciprocates to change the gap between the moving coil and the static coil. This adjustment of a cutting seam distance between the moving coil and the static coil only by the motion of the moving coil can meet an early experimental standard requirement, that is, when the requirement for a sound pressure level is not high in the case of a high frequency sound spectrum, the use of a structure in which a moving coil and a static coil fit with each other can meet the early experimental standard requirement. However, the current experimental standard requirement is that a higher requirement for the sound pressure level still remains in the case of the high frequency sound spectrum.

SUMMARY OF THE INVENTION

In view of the shortcomings in the prior art, the present invention provides a pneumatic sounder in which a higher sound pressure level can still be maintained in a high-intensity noise experimental standard requirement in the case of a high frequency sound spectrum, and provides a control system of the pneumatic sounder.

To achieve the above object, the present invention adopts the following technical solution: a pneumatic sounder, including an air flow outlet, an air flow inlet, and an electrical signal control system, characterized by further including double magnets and a double-moving coil assembly. The double magnets include a first magnet and a second magnet, and the double-moving coil assembly includes a first moving coil and a second moving coil. The first moving coil is disposed in a magnetic field of the first magnet, and the second moving coil is disposed in a magnetic field of the second magnet. The first moving coil and the second moving coil are connected to the electrical signal control system respectively, and the air flow inlet, the double-moving coil assembly, and the air flow outlet are sequentially disposed along a flow direction of an air flow.

Further, the pneumatic sounder further includes an air flow filter, disposed behind the air flow inlet and in front of the first magnet.

Further, a front air flow channel is formed between the outer periphery of the first magnet and the inner wall of the casting. The air flow entering from the air flow inlet reaches the double-moving coil assembly through the front air flow channel.

Further, the first moving coil and the second moving coil are disposed oppositely, and the first magnet and the second magnet are sequentially disposed along the flow direction of the air flow respectively.

Further, a feedback coil is disposed on the first moving coil and/or the second moving coil for acquiring a motion state signal of the moving coil.

The present invention further provides a control system of a pneumatic sounder, including:

a feedback coil disposed on a double-moving coil assembly, configured to generate a feedback signal when the double-moving coil assembly operates;

a signal adjuster, configured to receive the feedback signal sent by the feedback coil and adjust amplitude parameters of signals from a signal source; and a phase adjuster, configured to receive the feedback signal sent by the feedback coil and adjust phase parameters of the signals from the signal source.

Further, the control system of a pneumatic sounder further includes a power amplifier, configured to perform amplification processing on the signals from the signal source and send the amplified signals to the double-moving coil assembly.

Further, the signals with the phase parameters adjusted by the phase adjuster are transmitted to the double-moving coil assembly.

Further, the signals with the amplitude parameters adjusted by the signal processor are transmitted to the double-moving coil assembly.

Advantageous Effects (1) the present invention adopts a double-moving coil assembly, removes a static coil fitting with a moving coil highly accurately, removes frictional resistance of fitting between the original moving and static coils, and reduces machining accuracy requirements of the moving coil, thereby simplifying the processes;

(2) the double moving coils of the present invention always adopt a relative motion manner, that is, the double moving coils move towards or away from each other, under the control of signals, such that the modulated amplitude is doubled at the same signal intensity;

(3) by adopting the double moving coils, the present invention enhances the modulation efficiency of a cutting seam at the same drive electric power by 100%;

(4) by adopting the double moving coils, the present invention increases the modulated amplitude of a pneumatic generator at a high frequency and reduces energy consumption for driving the moving coils; and (5) by adopting the double moving coils, the present invention improves the reliability of a system and doubles the services lives of the moving coils.

Figure 1:
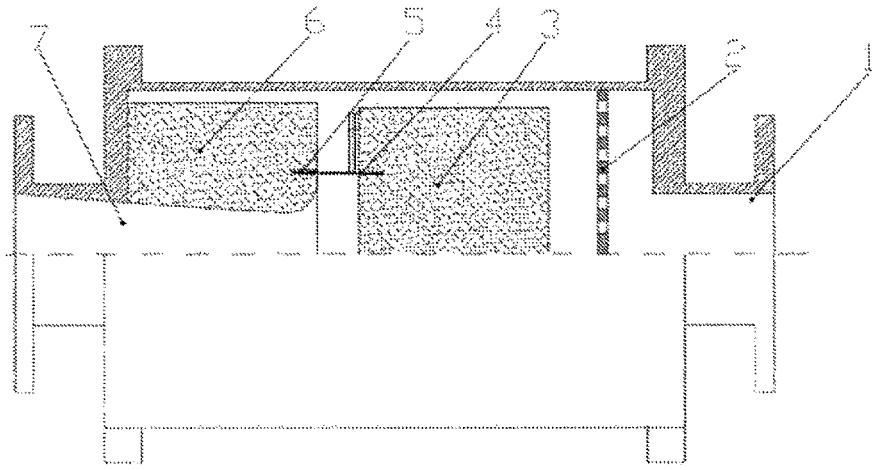
FIG. 1 is a schematic view of a structure of a pneumatic sounder of the present invention.

In the drawings, 1. air flow inlet; 2. air flow filter; 3. first magnet; 4. first moving coil; 5. second moving coil; 6. second magnet; 7. air flow outlet.

DESCRIPTION OF THE EMBODIMENTS

In order to make the objectives and technical solutions of embodiments of the present invention clearer, the technical solutions of embodiments of the present invention are clearly and completely described below with reference to the accompanying drawings of embodiments of the present invention. Apparently, the embodiments described are merely some, rather than all embodiments of the present invention. Based on the described embodiments of the present invention, all other embodiments obtained by persons of ordinary skill in the art without making creative efforts shall fall within the protection scope of the present invention.

One of ordinary skill in the art can understand that unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art, and will not be interpreted in an idealized or overly formal sense unless expressly so defined herein.

The terms "front" and "rear" in the present invention refer to the front and the rear in the flow direction of an air flow when an apparatus is in operation.

The terms "inner" and "outer" in the present invention respectively refer to, relative to the apparatus itself, the direction toward the interior of the apparatus and the opposite direction, and are not intended to particularly limit the device and mechanism of the present invention.

The term "connection" in the present invention may refer to direct connection between components or indirect connection between components by means of other components.

FIG. 1 is a schematic view of a structure of a pneumatic sounder of the present invention. The pneumatic sounder of the present invention includes an air flow outlet 7, an air flow inlet 1, and an electrical signal control system, and further includes double magnets and a double-moving coil assembly. The double magnets include a first magnet 3 and a second magnet 6, and the double-moving coil assembly includes a first moving coil 4 and a second moving coil 5. The first moving coil 4 is disposed in a magnetic field of the first magnet 3, and the second moving coil 5 is disposed in a magnetic field of the second magnet 6. The first moving coil 4 and the second moving coil 5 are connected to the electrical signal control system respectively, and the air flow inlet 1, the double-moving coil assembly, and the air flow outlet 7 are sequentially disposed along a flow direction of an air flow. A front air flow channel is formed between an outer periphery of the first magnet 3 and an inner wall of a casing, and an air flow entering from the air flow inlet 1 reaches the double-moving coil assembly through the front air flow channel.

With continuing reference to FIG. 1, the first moving coil 4 and the second moving coil 5 are disposed oppositely, a narrow gap is formed between the first moving coil 4 and the second moving coil 5, and the gas from the air flow inlet 1 will pass through the gap between the first moving coil 4 and the second moving coil 5.

The pneumatic sounder in one embodiment may further include an air flow filter 2, and the air flow filter 2 is disposed behind the air flow inlet 1 and in front of the first magnet 3 and is used to filter and purify the gas entering the pneumatic sounder.

In one embodiment, to optimize control processes of the first moving coil 4 and the second moving coil 5, a feedback coil is disposed on the first moving coil 4 and/or the second moving coil 5 for acquiring a motion state signal of the moving coil. Specific control processes will be set forth below.

Referring to FIG. 1, the pneumatic sounder of the present invention has one operating mode as follows: compressed air/nitrogen (the pressure may be 0.3-0.5 Mpa) enters the pneumatic sounder through the air flow inlet 1, and firstly reaches the filtration device 2. After the compressed air/nitrogen is filtered, the control system sends an inversion signal to the first moving coil 4 and the second moving coil 5 respectively to cause the two moving coils to move inversely, so as to cut the air flow passing through the gap between the first moving coil 4 and the second moving coil 5 to generate a pulsating pressure wave and to finally form a sound wave to be emitted through the air flow outlet.

Figure 2:
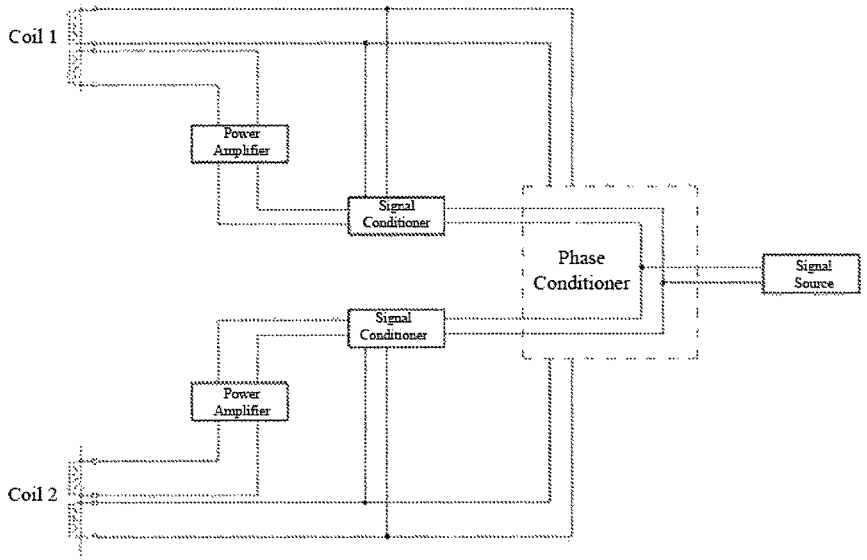
FIG. 2 is a schematic view of a control system of the pneumatic sounder of the present invention.

FIG. 2 is a schematic view of a control system of the pneumatic sounder of the present invention. The control system of the pneumatic sounder of the present invention includes: a feedback coil disposed on the double-moving coil assembly, used to generate a feedback signal when the double-moving coil assembly operates; a signal adjuster, used to receive the feedback signal sent by the feedback coil and adjust amplitude parameters of signals that are from a signal source and to be sent to the moving coils; and a phase adjuster, used to receive the feedback signal sent by the feedback coil and adjust phase parameters of the signals that are from the signal source and to be sent to the moving coils. The signals with the phase parameters adjusted by the phase adjuster are transmitted to the double-moving coil assembly. The signals with the amplitude parameters adjusted by the signal processor are transmitted to the double-moving coil assembly.

In one preferred embodiment, the control system further includes a power amplifier, used to perform amplification processing on the signals from the signal source and send the amplified signals to the double-moving coil assembly.

Referring to FIG. 2, the feedback signal of the feedback coil is transmitted to the signal adjuster and the phase adjuster via a feedback line respectively. In one embodiment, a signal resolver may be disposed in the feedback line. The signal resolver, for example, resolves the feedback signal as a signal including an amplitude parameter and a signal including a phase parameter, and transmits the two signals to the signal adjuster and the phase adjuster respectively, thereby enabling more accurate feedback processes and more reliable adjustment processes.

In one preferred embodiment, source signals sent from the signal source can firstly reach the phase adjuster for signal processing, next reach the signal adjuster for processing, then pass through the power amplifier for amplification processing, and finally be transmitted to the double-moving coil assembly. In another preferred embodiment, the source signals sent from the signal source can firstly reach the signal adjuster for processing, next reach the phase adjuster for signal processing, then pass through the power amplifier for amplification processing, and finally be transmitted to the double-moving coil assembly.

The implementations of the present invention are specifically described in detail above, but they are not to be construed as limiting the scope of the present invention. It should be noted that several variations and modifications can be made by those of ordinary skill in the art without departing from the concept of the present invention, and that these variations and modifications all fall within the scope of protection of the present invention.

What is claimed is:

1. A pneumatic sounder, comprising:

an air flow inlet;

a first magnet;

a first moving coil disposed in a first magnetic field of the first magnet;

a second magnet;

a second moving coil disposed in a second magnetic field of the second magnet; and an air flow outlet, wherein the air flow inlet, the first moving coil, the second moving coil and the air flow outlet are sequentially disposed along a flow direction of an air flow entering the pneumatic sounder.

2. The pneumatic sounder of claim 1, further comprising an air flow filter disposed between the air flow inlet and the first magnet.

3. The pneumatic sounder of claim 1, wherein a front air flow channel is formed between an outer periphery of the first magnet and an inner wall of a casing of the pneumatic sounder, so that an air flow entering the air flow inlet can pass through the front air flow channel and then reach the first and second moving coils.

4. The pneumatic sounder of claim 1, wherein the first and the second moving coils are disposed oppositely.

5. The pneumatic sounder of claim 1, further comprising a control system connected to the first and second moving coils.

6. The pneumatic sounder of claim 5, wherein the control system comprises:

a feedback coil disposed on the first moving coil, the second moving coil, or both of the first and second moving coils for acquiring motion state signals thereof, wherein the feedback coil can generate a feedback signal when the first and second moving coils are in operation.

7. The pneumatic sounder of claim 6, wherein the control system further comprises a power amplifier to amplify the signals generated by the signal source and sent to the first and second moving coils.

8. A control system for the pneumatic sounder of claim 1, comprising:

a feedback coil disposed on the first moving coil, the second moving coil, or both of the first and second moving coils for acquiring motion state signals thereof, wherein the feedback coil can generate a feedback signal when the first and second moving coils are in operation;

a signal adjuster configured to receive the feedback signal and adjust amplitude parameters of signals, generated by a signal source, sent to the first and second moving coils; and a phase adjuster configured to receive the feedback signal and adjust phase parameters of signals sent to the first and second moving coils.

9. The control system of claim 8, further comprises a power amplifier to amplify the signals sent to the first and second moving coils.

* * * * *